US008882519B2

(12) United States Patent
White

(10) Patent No.: US 8,882,519 B2
(45) Date of Patent: Nov. 11, 2014

(54) DUST CAP FOR A TELECOMMUNICATIONS CONNECTOR

(71) Applicant: Tyco Electronics UK Ltd., Swindon (GB)

(72) Inventor: Gordon John White, Gloucester (GB)

(73) Assignee: Tyco Electronics UK Ltd. (GB)

( * ) Notice: Subject to any disclaimer, the term of this patent is extended or adjusted under 35 U.S.C. 154(b) by 0 days.

(21) Appl. No.: 13/828,934

(22) Filed: Mar. 14, 2013

(65) Prior Publication Data

US 2013/0260582 A1 Oct. 3, 2013

Related U.S. Application Data

(60) Provisional application No. 61/616,709, filed on Mar. 28, 2012.

(51) Int. Cl.
*H01R 13/44* (2006.01)

(52) U.S. Cl.
USPC ..... 439/142; 439/144

(58) Field of Classification Search
USPC ..... 439/142, 144; 174/67
See application file for complete search history.

(56) References Cited

U.S. PATENT DOCUMENTS

| | | | | |
|---|---|---|---|---|
| 3,666,996 | A * | 5/1972 | Brown | 361/823 |
| 4,721,476 | A * | 1/1988 | Zeliff et al. | 439/142 |
| 4,760,215 | A * | 7/1988 | Cook et al. | 174/67 |
| 5,571,023 | A * | 11/1996 | Anthony | 439/142 |
| 5,769,647 | A | 6/1998 | Tulley et al. | |
| 6,292,564 | B1 | 9/2001 | Cowan et al. | |
| 6,425,694 | B1 | 7/2002 | Szilagyi et al. | |
| 6,612,750 | B1 | 9/2003 | Bull et al. | |
| 6,652,152 | B2 | 11/2003 | Yang et al. | |
| 6,702,477 | B1 | 3/2004 | Ngo | |
| 6,848,833 | B1 | 2/2005 | Kamarauskas et al. | |
| 7,029,182 | B2 | 4/2006 | Ngo | |
| 7,087,840 | B2 | 8/2006 | Herring et al. | |
| 7,273,383 | B1 | 9/2007 | Bennett | |
| 7,340,146 | B2 | 3/2008 | Lampert et al. | |

(Continued)

FOREIGN PATENT DOCUMENTS

| | | |
|---|---|---|
| JP | 2006-126807 | 5/2006 |
| KR | 10-2001-0100594 | 11/2001 |

OTHER PUBLICATIONS

International Search Report and Written Opinion for PCT/US2013/033113 mailed Jul. 23, 2013.

*Primary Examiner* — Hien Vu
(74) *Attorney, Agent, or Firm* — Merchant & Gould P.C.

(57) ABSTRACT

A dust cap (100) for covering a jack recess (206) in a telecommunications jack (200) is disclosed. In one embodiment, the dust cap (100) includes a cover portion (110) attached to a hinge base (150). The cover portion (110) is rotatable from a closed position, wherein the cover portion (110) covers the jack recess (206), to an open position, wherein the jack recess (206) is exposed. The cover portion (110) may include a securing feature (114, 116) configured to engage with the jack recess (206) to retain the cover portion (110) in the closed position. The front face (110*a*) of the cover portion (110) may also include a handle (112). The dust cap (100) may also include an adhesive (156) located on a rear face (150*b*) of the hinge base (150) that is configured to engage with a front face (204) of the telecommunications jack (200) to secure the dust cap (100) to the telecommunications jack (200).

12 Claims, 12 Drawing Sheets

(56) References Cited

U.S. PATENT DOCUMENTS 7,676,133 B2 3/2010 Lampert et al.
2003/0081907 A1 5/2003 Malagrino, Jr. et al.
2007/0054521 A1 3/2007 John
2011/0038581 A1 2/2011 Mudd et al.

* cited by examiner

DUST CAP FOR A TELECOMMUNICATIONS CONNECTOR

RELATED APPLICATIONS

The present application claims priority to U.S. Provisional Patent Application Ser. No. 61/616,709, filed Mar. 28, 2012, which is incorporated herein by reference in its entirety.

TECHNICAL FIELD

The present disclosure relates to dust caps for protecting an unused telecommunications connector.

BACKGROUND

Electrical connectors, for example RJ-type connectors, are useful for providing wall sockets where electronic data cables can be terminated and mating electrical plugs can be inserted. A problem with such electrical connectors can occur when dust, dirt or other contaminants come into contact with electrically conductive elements inside the connector. Such contaminants may cause corrosion, unintended conduction or adhesion of components that impedes their movement. Ingress of contaminants into the electrical connector may be particularly likely when the connector is placed in a wall cavity. This may be the case when building works generate abrasions and contaminants, for example.

Some electrical connectors, such as some RJ-type connectors, are assembled in such a way that an exposed cavity containing one or more conductive elements of the electrical connector is not covered once installed. This exposed cavity may be prone to accumulation of contaminants. It is generally desirable to overcome or ameliorate one or more of the above described difficulties, or at least provide a useful alternative.

SUMMARY

A dust cap for covering a jack recess in a telecommunications jack is disclosed. In one embodiment, the dust cap includes a cover portion attached to a hinge base. The cover portion is rotatable from a closed position, wherein the cover portion covers the jack recess, to an open position, wherein the jack recess is exposed. The cover portion may include a securing feature located on a rear face of the cover portion that is configured to engage with the jack recess to retain the cover portion in the closed position. The cover portion may also include a handle portion located on a front face of the cover portion that is configured to allow a user to move the cover portion between the open and closed positions with a single phalange. The dust cap may also include an adhesive located on a rear face of the hinge base that is configured to engage with a front face of the telecommunications jack to secure the dust cap to the telecommunications jack.

DESCRIPTION OF THE DRAWINGS

Non-limiting and non-exhaustive embodiments are described with reference to the following figures, which are not necessarily drawn to scale, wherein like reference numerals refer to like parts throughout the various views unless otherwise specified.

DETAILED DESCRIPTION

Figure 1:
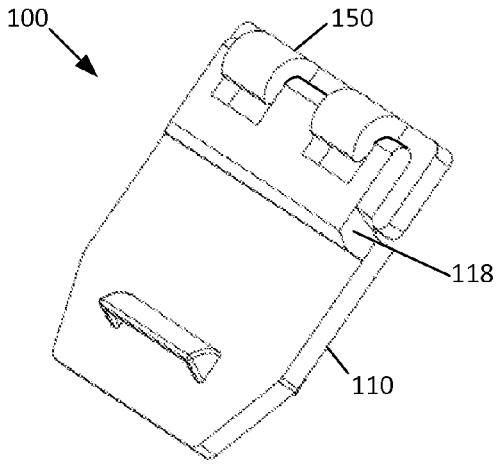
FIG. 1 is a front perspective view of a dust cap having features that are examples of aspects in accordance with the principles of the present disclosure.
Figure 2:
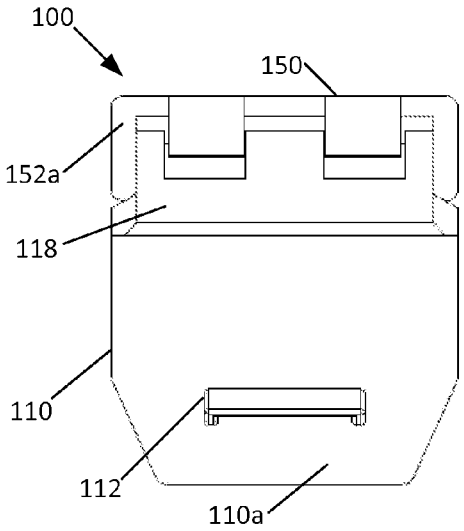
FIG. 2 is a front view of the dust cap shown in FIG. 1.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Referring now to FIGS. 1-4, an example dust cap 100 is shown. Dust cap 100 is for protecting a telecommunications jack 200 of a modular connector from dust and other contaminants when the modular connector is not engaged with a plug 300. One type of modular connector suitable for use with dust cap 100 is an RJ type connector, for example, an RJ45 type connector. Jack 200 includes contact springs 208 on the inside of the jack for contacting a mating plug 300. One skilled in the art will appreciate that dust cap 100 may be used in conjunction with a wide variety of modular type connector jacks, for example fiber optic adapters. In the embodiment shown, dust cap 100 includes a cover portion 110 rotatably connected to a hinge base 150.

Figure 11:
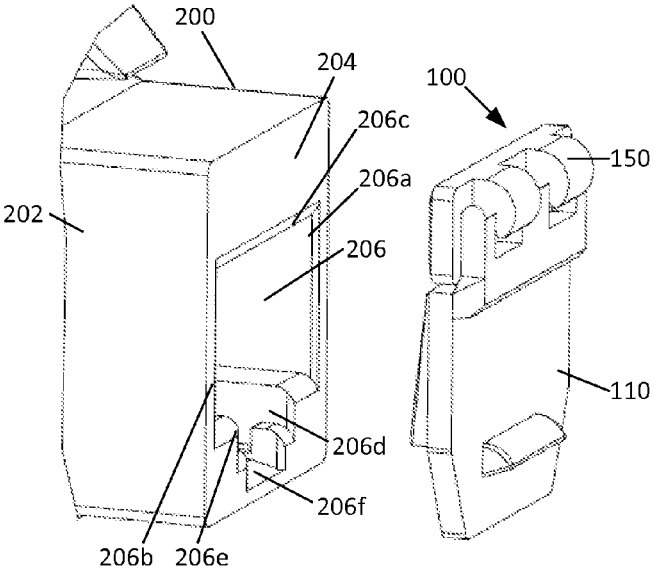
FIG. 11 is a front perspective view of the dust cap shown in FIG. 1 in addition to a jack receptacle suitable for attachment of the dust cap.
Figure 12:
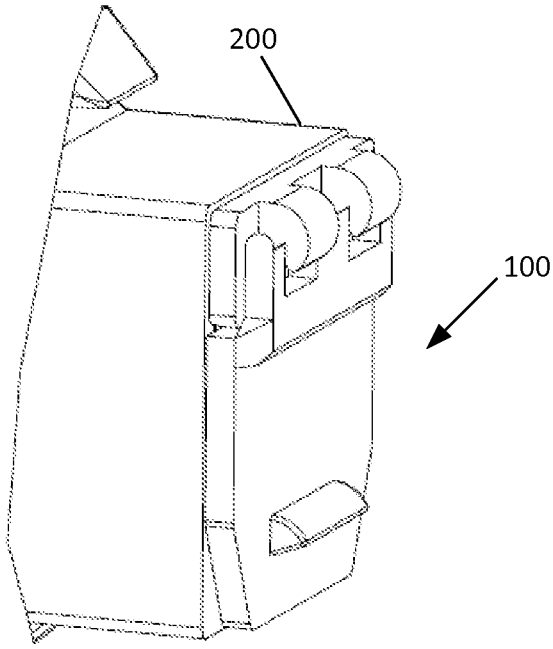
FIG. 12 is a front perspective view of the dust cap shown in FIG. 1 attached to the jack receptacle shown in FIG. 11 with the dust cap in a closed position.
Figure 13:
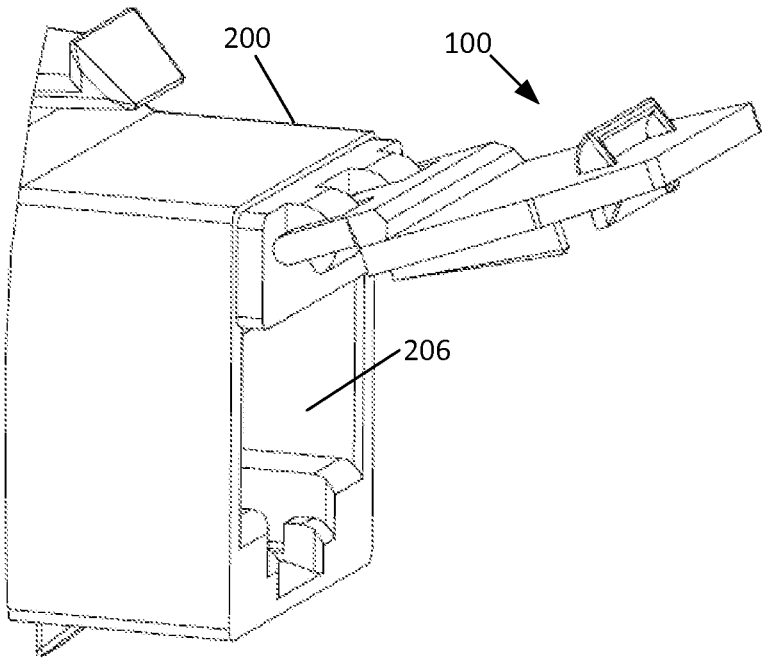
FIG. 13 is a front perspective view of the dust cap shown in FIG. 1 attached to the jack receptacle shown in FIG. 11 with the dust cap in an open position.
Figure 14:
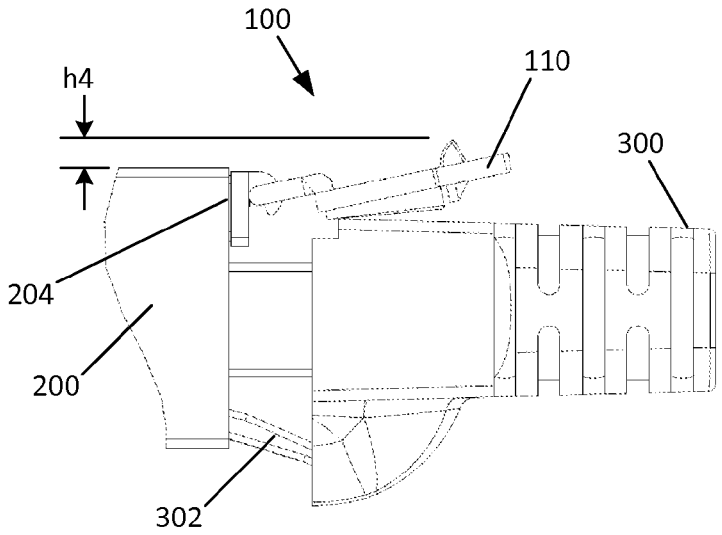
FIG. 14 is a side view of the dust cap shown in FIG. 1 attached to the jack receptacle shown in FIG. 11 with a plug inserted into the jack receptacle.
Figure 26:
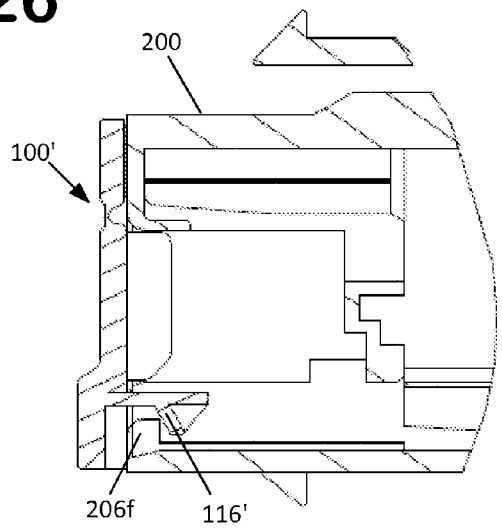
FIG. 26 is a cross-sectional view of the dust cap and hinge shown in FIG. 24 taken along the line 26-26 shown in FIG. 25.

As shown, cover portion 110 has a front face 110*a* and a rear face 110*b*. When the dust cap 100 is mounted on a jack 200, the cover portion 110 is oriented such that the front face 100*a* is outward facing while the rear face 110*b* faces towards a recess 206 in the main body 202 of the jack 200. An example jack receptacle 200 is shown at FIGS. 11-13. These figures also show the orientation of the cover portion 110 with respect to the jack receptacle 200. Cross-sectional views of a jack receptacle 200 are also provided at FIGS. 26-28.

Located on the front face 110*a* is a handle 112 configured to allow a user to manipulate the cover portion 110 such that the dust cap 100 can be moved from a closed position to an open position. The dust cap 100 is shown as being in the closed position at FIGS. 12 and 12A, and as being in the open position at FIGS. 13-17. In the example embodiment shown, the handle 112 is configured to allow this action to be initiated by using a single phalange (i.e. a finger and/or a fingernail).

Figure 3:
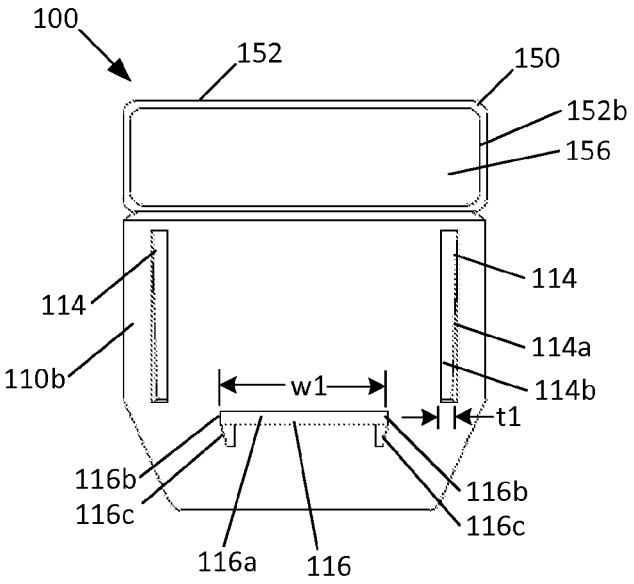
FIG. 3 is a rear view of the dust cap shown in FIG. 1.
Figure 4:
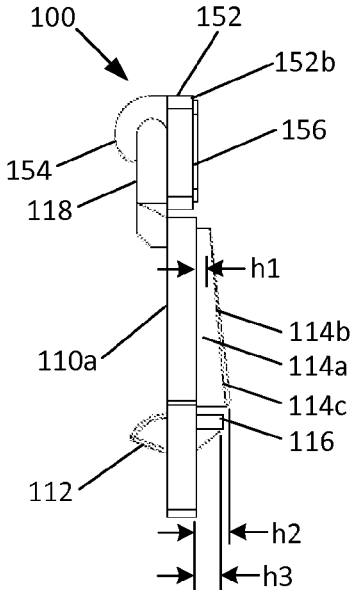
FIG. 4 is a side view of the dust cap shown in FIG. 1.
Figure 5:
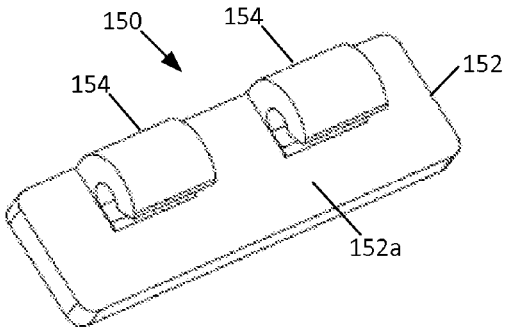
FIG. 5 is a front perspective view of a hinge base of the dust cap shown in FIG. 1.

As most easily seen at FIGS. 3 and 4, a plurality of securing features 114, 116 are located on the rear face 110*b* of the cover portion 110. Securing features 114, 116 are for retaining the dust cap 100 in the closed position and/or providing an alignment function when mounting dust cap 100 to jack 200. Many configurations and variations of the securing features 114, 116 are possible. Additionally, dust cap 100 may be provided with only one of securing features 114 and 116. In the example embodiment shown, securing features 114, 116 are configured to frictionally engage the interior sidewalls of the jack recess 206. One skilled in the art will appreciate that other types of engagement connections may be utilized, for example, snap fit connections. Additionally, that more or fewer securing features than what are shown may be utilized.

As shown, first securing features 114 run generally parallel to and engage with side walls 206*a* and 206*b* of the jack recess 206 at a location that is below the top wall 206*c* and above the inset side walls 206*d*, 206*e*, as shown in FIG. 11. As most easily seen at FIGS. 3 and 4, each securing feature 114 includes a side wall 114*a* having a thickness t1 and at least one end wall 114*b*. In the embodiment shown, side wall 114*a* increases from a first height h1 in a direction from the hinge base 150 towards the securing feature 116 to a second height h2, as can be seen at FIG. 4. Each first securing feature 114 can also be optionally provided with a chamfered portion 114*c*. The chamfered portion 114*c* and the increasing height of sidewall 114*a* allow for the cover portion 110 to register more easily into the jack recess 206 when being moved from the open position into the closed position. One skilled in the art, upon learning of the disclosure, will understand that chamfered portion 114*c* need not be present such that the sidewall 114*a* and end portion 114*b* are generally squared.

With reference to second securing feature 116, a horizontal wall 116*a* is provided and supported by a pair of support features 116*c*. The horizontal wall 116*a* has a width w1 and a height h3. Horizontal wall 116*a* also has sides 116*b*. The width w1 is such that, when the cover portion 110 is moved to the closed position, the sides 116*b* frictionally engage with side walls 206*d* and 206*e* of the jack recess 206 that are located just above the plug latch tab connection 206*f*. Side walls 206*d* and 206*e* and latch tab connection 206*f* are most easily seen at FIGS. 11 and 13.

Figure 1A:
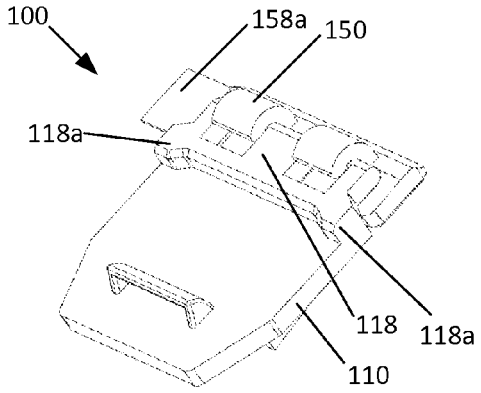
FIG. 1*a* is a front perspective view of a dust cap of FIG. 1 with additional material being provided for a hinge member of the dust cap.
Figure 6:
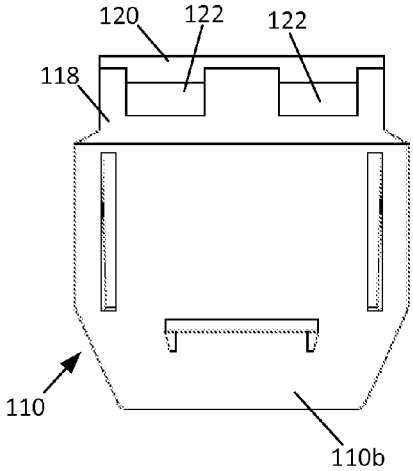
FIG. 6 is a rear view of a cover portion of the dust cap shown in FIG. 1.

Referring back to FIGS. 1-4, cover portion 110 is shown as additionally including an extension member 118. In the embodiment shown, extension member 118 is integrally formed onto the front face 110*a* of cover portion 110 and functions to connect the cover portion 110 with the hinge base 150. As can be seen at FIG. 6, extension member 118 includes a male hinge member 120 that is received in recesses 154*a* of corresponding female hinge members 154 in the hinge base 150. This arrangement provides for a snap-fit arrangement in which no tools are required to join or separate the hinge base 150 and the cover portion 110. It is noted that hinge member 120 could be alternatively configured as a female hinge member and hinge members 154 could be alternatively configured as male hinge members. Other types of rotatable connections between cover portion 110 and hinge base 150 are possible. Extension portion 118 also includes a pair of apertures 122 for allowing the hinge portions 154 to rotate through the cover 110 when the dust cap 100 is moved to the open position. With reference to FIG. 1*a*, the extension member 118 can be formed with additional material at location 118*a* to increase wall thickness to aid in the position of the material feed point.

Figure 5A:
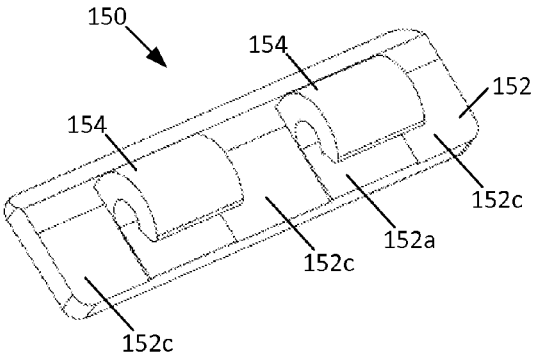
FIG. 5*a* is a front perspective view of a hinge base of the dust cap shown in FIG. 1 with relieved surfaces.
Figure 7:
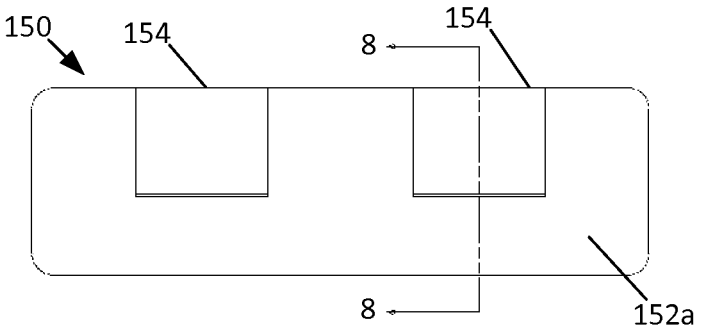
FIG. 7 is a front view of the hinge base of the dust cap shown in FIG. 1.
Figure 8:
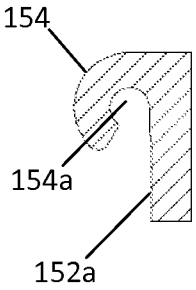
FIG. 8 is a cross-sectional view of the hinge base of the dust cap shown in FIG. 1 taken along the line 8-8 in FIG. 7.
Figure 9:
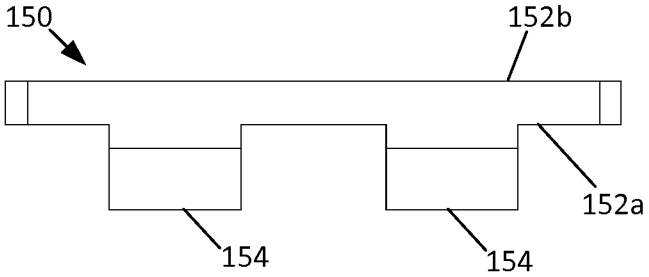
FIG. 9 is a top view of the hinge base of the dust cap shown in FIG. 1.

Referring to FIGS. 3-5 and 7-9, the hinge base 150 is shown in greater detail. As shown, the hinge base 150 includes a main body 152 having a front face 152*a* and a rear face 152*b*. When the hinge base 150 is connected to the cover portion 110, the front face 152*a* faces in the same direction as the front face 110*a* of the cover portion 110. The rear face 152*b* is for securing the dust cap 100 to the front face 204 of the jack 200. In the embodiment shown, the rear face 152*b* has a surface area that is less than the surface area of the front face 204 of the jack 200. With reference to FIG. 5*a*, the hinge base can be provided with recessed portions 152*c* that increase clearance between the hinge base 150 and the extension member 118 of the cover portion 110 such that the cover portion can rotate beyond 180 degrees.

Figure 10:
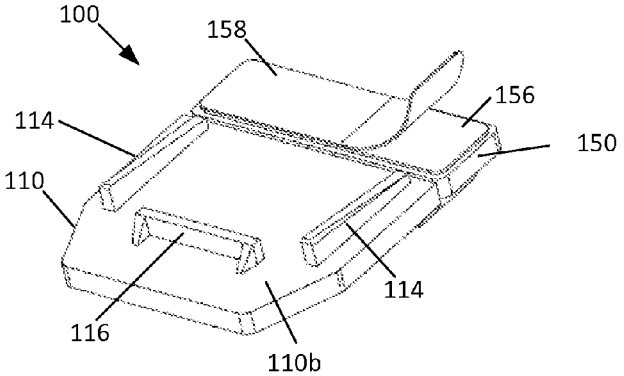
FIG. 10 is a rear perspective view of the dust cap shown in FIG. 1.
Figure 10A:
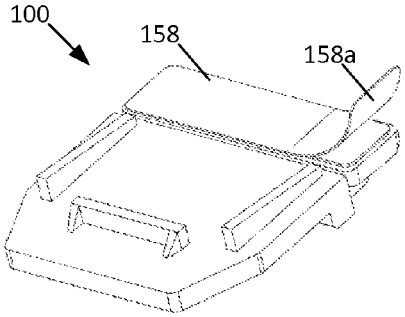
FIG. 10*a* is a rear perspective view of the dust cap shown in FIG. 1 with a tabbed release liner.

In the embodiment shown, the rear face 152*b* is provided with an adhesive 156 for adhesively attaching the hinge base 150 to the jack front face 204. In the embodiment shown, adhesive 156 covers a majority of the rear surface 150*b* of the hinge base 150. Many types of adhesives are suitable for this purpose. For example, adhesive 156 may be a double-sided polyurethane foam tape, such as 3M™ MULTIPURPOSE MOUNTING TAPE 4016. In another embodiment, the adhesive 156 is a pressure sensitive double-sided acrylic tape, such as 3M™ VHB™ HEAVY DUTY MOUNTING TAPE 4910. Where using a double-sided tape, one side may be bonded to the rear face 152*b* of the hinge base 150, and the other side may be bonded to the front face 204 of the jack 200. In other embodiments, a liquid or semi-liquid adhesive may be applied to the rear face 152*b* rather than a tape. Referring to FIG. 10, the adhesive 156 may be additionally provided with a release liner 158 for protecting the adhesive 156 prior to application. The release liner 158 may be made from a variety of materials, such as polyethylene or kraft paper, provided they are compatible with the underlying adhesive 156. As shown at FIG. 10*a*, the release liner 158 can be provided with an extension tab 158*a* that extends beyond the hinge base 150 for easier removal of the release liner 158.

Referring to FIG. 11, the dust cap 100 is shown as being aligned with the front face 204 of a jack 200 prior to attachment of the jack 200. When installing the dust cap 100, a release liner 158 would be removed prior to attachment. FIG. 12 shows the dust cap 100 having been attached to the jack 200 wherein the hinge base 150 is adhesively attached to the front face 204 of the jack 200, and with the cover portion 110 completely covering the jack recess 206. Not only do securing features 114, 116 retain the cover portion 110 in the closed position, they also serve as alignment guides when initially attaching the dust cap 100 to the jack 200 such that the hinge base 150 is properly oriented on the jack front face 204.

Referring to FIGS. 13-17, the dust cap 100 is shown as being in the open position such that the jack recess 206 is exposed, and such that a plug 300 may be inserted into the jack recess 206. Plug 300 terminates a cable to be connected to jack 200. As can be most easily seen at FIG. 14, where the dust cap 100 is in the open position and resting on the top of an inserted plug 300, the uppermost part (handle portion 112) of the cover portion 110, extends a vertical distance h4 above the top of the front face 204 of the jack 200. The small increase in height above the jack front face 204 defined by vertical distance h4 is a result of the dust cap 100 having an adhesively attached, front mounted design and the result of the hinge design principles disclosed herein.

Figure 15:
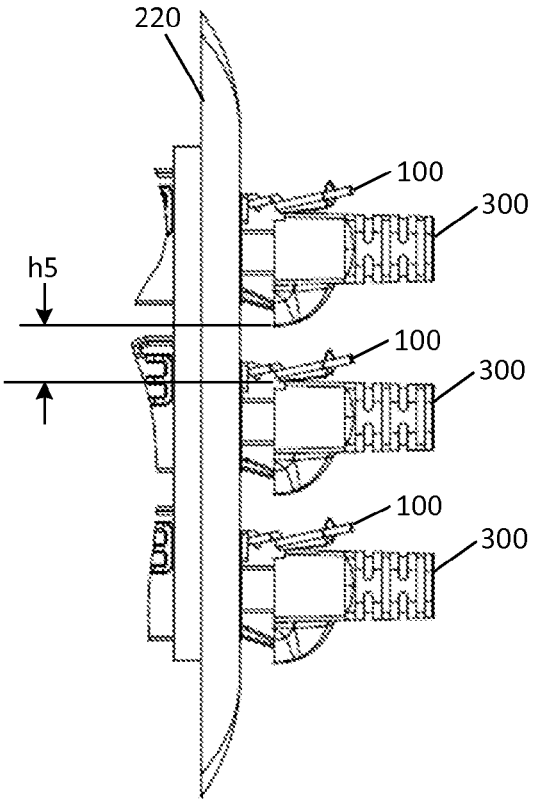
FIG. 15 is a side view of an arrangement of a plurality of plugs inserted into jack receptacles, each receptacle having the dust cap shown in FIG. 1.
Figure 16:
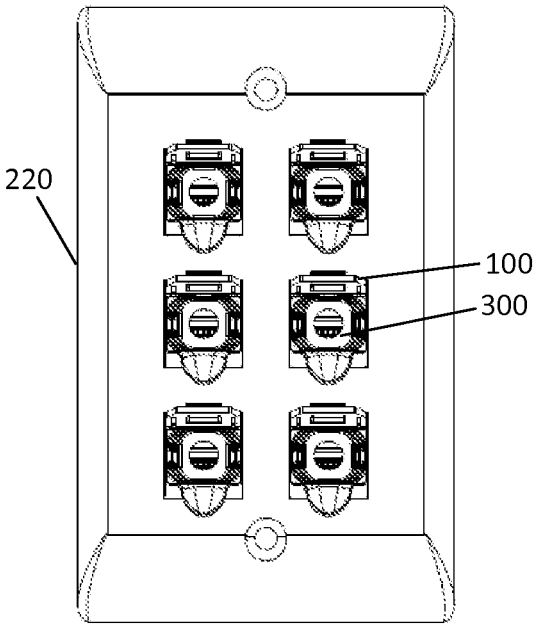
FIG. 16 is a front view of the arrangement shown in FIG. 14.
Figure 17:
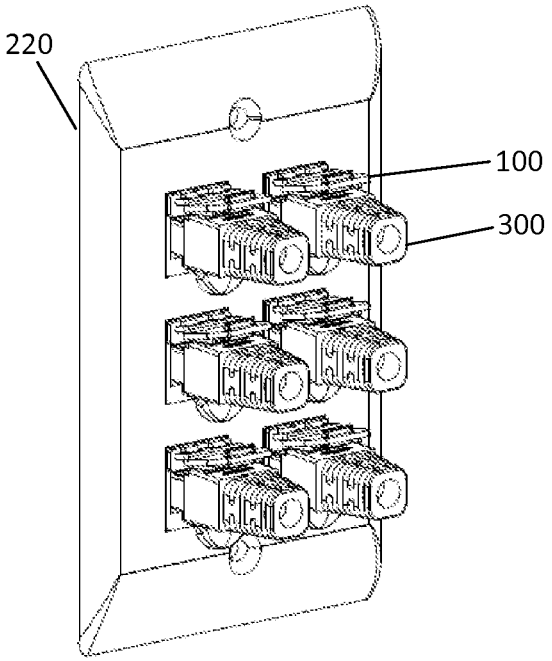
FIG. 17 is a front perspective view of the arrangement shown in FIG. 14.
Figure 18:
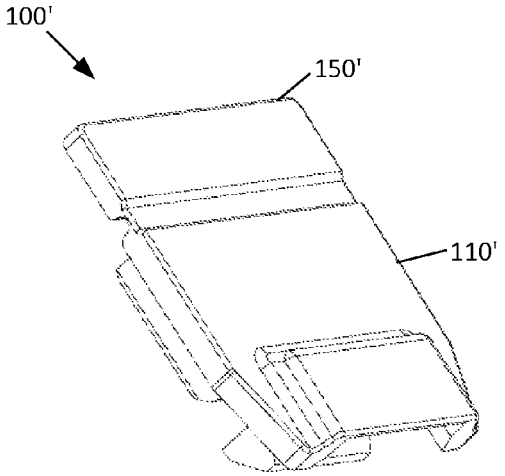
FIG. 18 is a front perspective view of a second embodiment of a dust cap having features that are examples of aspects in accordance with the principles of the present disclosure.
Figure 19:
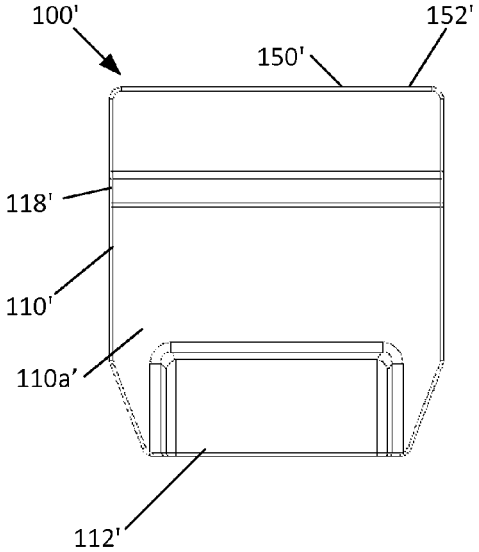
FIG. 19 is a front view of the dust cap shown in FIG. 18.
Figure 20:
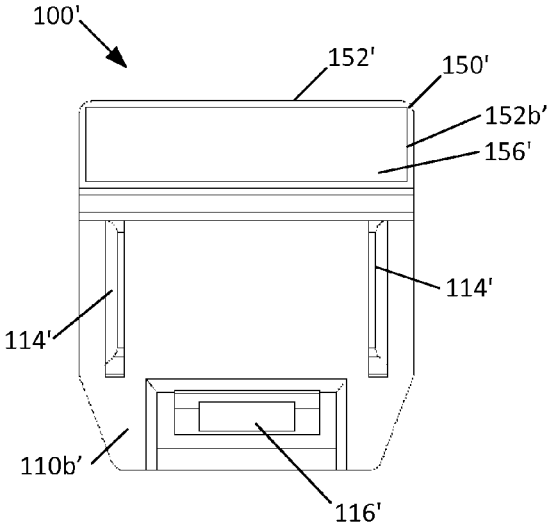
FIG. 20 is a rear view of the dust cap shown in FIG. 18.
Figure 21:
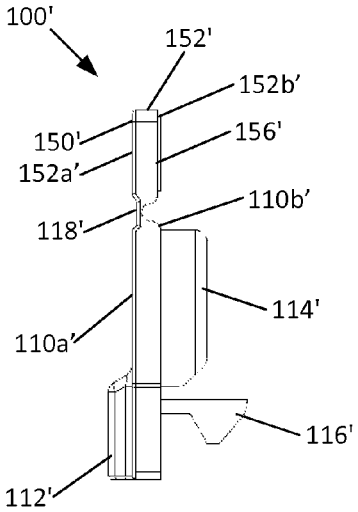
FIG. 21 is a side view of the dust cap shown in FIG. 18.

Referring to FIG. 15, a standard multiple jack arrangement is shown having three rows of jacks 200, each configured to receive a plug 300. As can be seen the total available clearance between the top and bottom of adjacent plugs 300 is a clearance distance h5. Accordingly, the vertical distance h4 is less than the clearance distance h5, thereby allowing for the use of dust cap 100 in a standard multiple jack arrangement. Furthermore, because the dust cap 100 is designed to be attached to the front face 204 of each jack 200, there is no interference provided by the dust cap 100 and an installed wall cover plate 220, as shown in FIGS. 16-17. As a result, the disclosed dust cap 100 is especially suitable for retrofit applications.

Referring to FIGS. 18-26, a second embodiment of a dust cap 100' is presented. As many of the concepts and features are similar to the first embodiment shown in FIGS. 1-17, the description for the first embodiment is hereby incorporated by reference for the second embodiment, and vice versa. Where like or similar features or elements are shown, the same reference numbers will be used where possible.

As shown, the dust cap 100' has a cover portion 110' and a hinge base 150' connected to each other by a living hinge 118'. By use of the term "living hinge" it is meant to mean a relatively thin, flexible hinge made from the same material as the cover portion 110' and the hinge base 150'. This configuration allows for the dust cap 100' to be produced in a single manufacturing step, as no assembly of the hinge base 150' and the cover portion 110' is required.

In the embodiment shown, the cover portion 110' includes a front face 110*a*' and a rear face 110*b*. Located on the front face 110*a*' is a handle portion 112' molded into the body of the cover portion 110'. Handle portion 112' is configured to allow a user to manipulate the cover portion 110' such that the dust cap 100' can be moved from a closed position to an open position. The dust cap 100' is shown as being in the closed position at FIGS. 23 and 25-26, and as being in the open position at FIG. 24. In the example embodiment shown, the handle 112' is configured to allow this action to be initiated by using a single phalange (i.e. a finger and/or a fingernail).

Similar to the first embodiment, dust cap 100' also includes a plurality of securing features 114', 116' located on the rear face 110*b*' of the cover portion 110'. Securing features 114', 116' are for retaining the dust cap 100' in the closed position. Many configurations and variations of the securing features 114', 116' are possible. In the example embodiment shown, securing features 114' are configured to frictionally engage the interior sidewalls 206*a*, 206*b* of the jack recess 206. Additionally, securing feature 116' is configured to complete a snap-fit connection with the plug latch tab connection 206*f* in a manner similar to how the plug 300 latch tab 302 engages with the jack 200. In the exemplary embodiment shown, securing feature 116' is formed onto the handle portion 112'. The configuration of the securing features 114', 116' with respect to the jack 200 is most easily seen in the cross-sectional view provided at FIG. 26. One skilled in the art will appreciate that other types of engagement connections may be utilized. Additionally, one skilled in the art will appreciate that more or fewer securing features may be utilized.

Referring to FIGS. 18-22, the hinge base 150' is shown in greater detail. As shown, the hinge base 150' includes a main body 152' having a front face 152*a*' and a rear face 152*b*'. When the hinge base 150' is connected to the cover portion 110', the front face 152*a*' faces in the same direction as the front face 110*a*' of the cover portion 110'. The rear face 152*b*' is for securing the dust cap 100 to the front face 204 of the jack 200. In the embodiment shown, the rear face 152*b*' has a surface area that is less than the surface area of the front face 204 of the jack 200.

Figure 22:
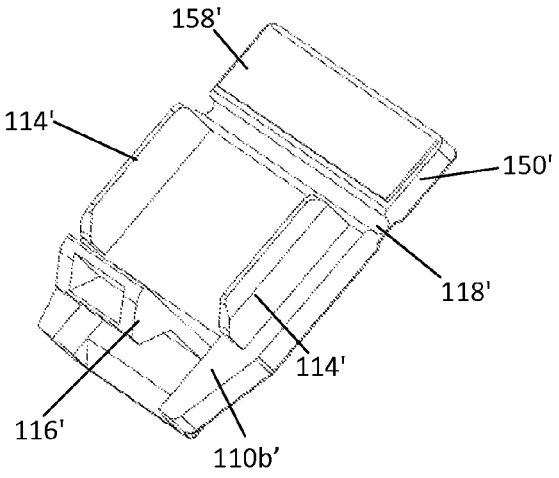
FIG. 22 is a rear perspective view of the dust cap shown in FIG. 18.
Figure 23:
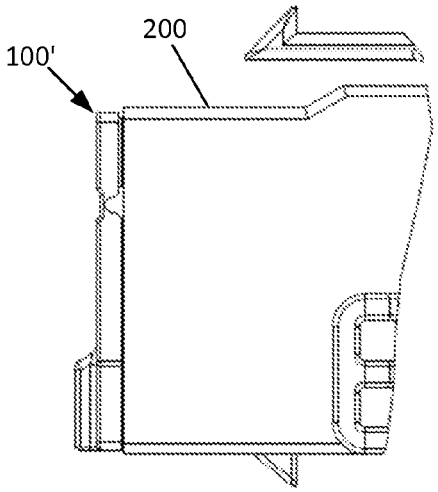
FIG. 23 is a side view of the dust cap shown in FIG. 18 attached to a jack receptacle, and in a closed position.

In the embodiment shown, the rear face 152*b*' is provided with an adhesive 156' for adhesively attaching the hinge base 150' to the jack front face 204. In the embodiment shown, adhesive 156 covers a majority of the rear surface 150*b* of the hinge base 150. Many types of adhesives are suitable for this purpose. For example, adhesive 156' may be a double-sided polyurethane foam tape, such as 3M™ MULTIPURPOSE MOUNTING TAPE 4016. In another embodiment, the adhesive 156' is a pressure sensitive double-sided acrylic tape, such as 3M™ VHB™ HEAVY DUTY MOUNTING TAPE 4910. Where using a double-sided tape, one side may be bonded to the rear face 152*b*' of the hinge base 150', and the other side may be bonded to the front face 204 of the jack 200. In other embodiments, a liquid or semi-liquid adhesive may be applied to the rear face 152*b*' rather than a tape. Referring to FIG. 22, the adhesive 156' may be additionally provided with a release liner 158' for protecting the adhesive 156' prior to application. The release liner 158' may be made from a variety of materials, such as polyethylene or kraft paper, provided they are compatible with the underlying adhesive 156'.

Figure 24:
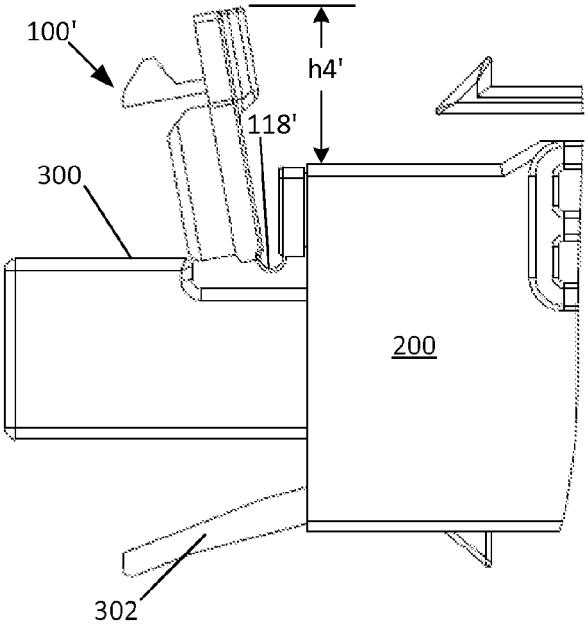
FIG. 24 is a side view of the dust cap shown in FIG. 18 attached to the jack receptacle shown in FIG. 23 in an open position, and with a plug inserted into the receptacle.
Figure 25:
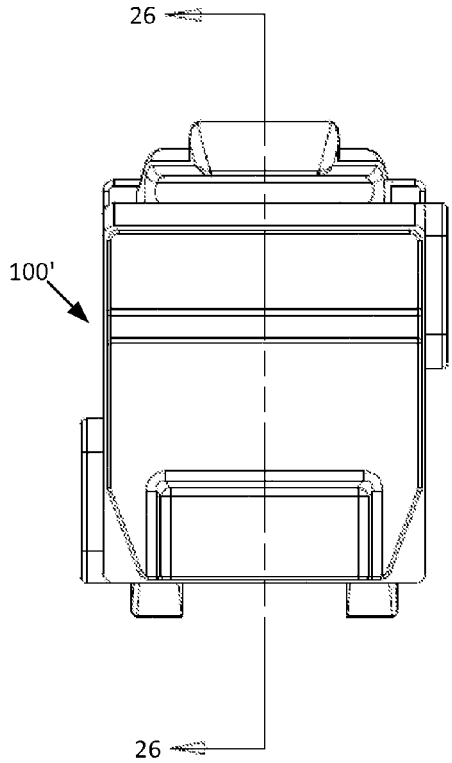
FIG. 25 is a front view of the dust cap shown in FIG. 18 attached to a jack receptacle.

Referring to FIG. 24, the dust cap 100' is shown as being in the open position such that the jack recess 206 is exposed, and such that a plug 300 may be inserted into the jack recess 206. When the dust cap 100' is in the open position and resting on the top of an inserted plug 300, the uppermost part of the cover portion 110', extends a vertical distance h4' above the top of the front face 204 of the jack 200. In one embodiment, distance h4' is less than the clearance distance h5 shown for the first embodiment, thereby allowing for the use of dust cap 100' in a standard multiple jack arrangement. Furthermore, because the dust cap 100' is designed to be attached to the front face 204 of each jack 200, there is no interference provided by the dust cap 100' and a wall cover plate 220 that may be installed in some applications. It is also noted that distance h4' is minimized due to the living hinge 118' being located at the bottom of the hinge base 150'. As a result, the disclosed dust cap 100' is especially suitable for retrofit applications.

Figure 27:
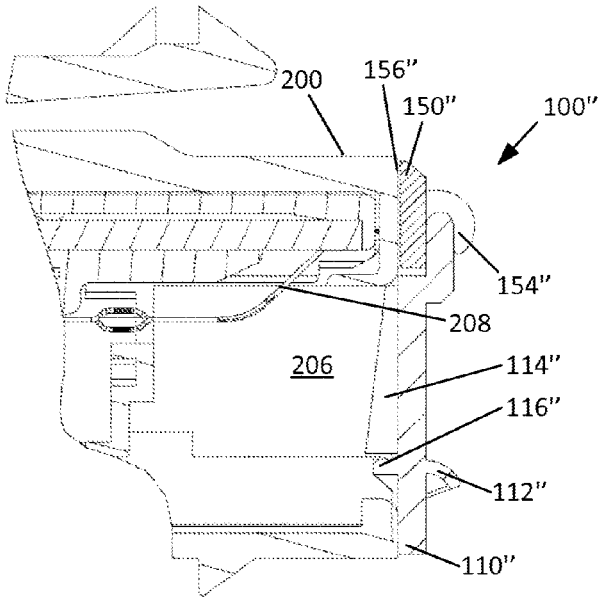
FIG. 27 is a cross-sectional side view of a third embodiment of a dust cap having features that are examples of aspects in accordance with the principles of the present disclosure, wherein the dust cap is attached to the jack receptacle shown in FIG. 11 with the dust cap in a closed position.
Figure 28:
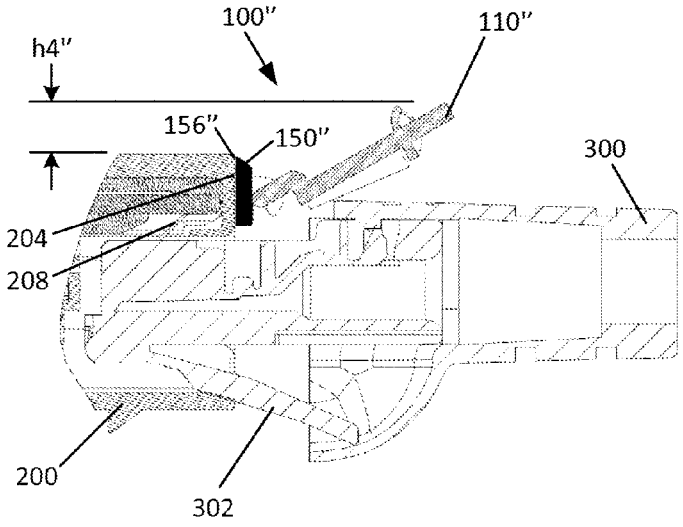
FIG. 28 is a cross-sectional side view of the dust cap shown in FIG. 27 attached to the jack receptacle shown in FIG. 11 with the dust cap in an open position, and with a plug inserted into the receptacle.

Referring to FIGS. 27-28, a third embodiment of a dust cap 100" is presented. As many of the concepts and features are similar to the first embodiment shown in FIGS. 1-17, the description for the first embodiment is hereby incorporated by reference for the third embodiment, and vice versa. Where like or similar features or elements are shown, the same reference numbers will be used where possible. Due to the similarities between the first and third embodiments, the following description for the third embodiment will be limited primarily to the differences between the first and third embodiments.

As can be seen at FIGS. 27-28, dust cap 100" has a cover portion 110" hingedly attached to a hinge base 150". Similar to the first embodiment, cover portion 110" has a handle feature 112" and securing features 114", 116" while hinge base 150" has an adhesive 156" and hinge portions 154". The third embodiment differs from the first embodiment in that the hinge base 150" in two ways. First, the hinge base 150" has a sloped surface 150*a*" at its upper end. This surface allows for somewhat greater clearance between vertically spaced jacks 200. Second, the third embodiment dust cap 100" has hinge members 154" that are located more towards the middle of the hinge base 150" as compared to the first embodiment. This location accommodates the sloped surface 150*a*". When the dust cap 100" is in the open position and resting on the top of an inserted plug 300, the uppermost part of the cover portion 110", extends a vertical distance h4" above the top of the front face 204 of the jack 200. In one embodiment, distance h4" is less than the clearance distance h5 shown for the first embodiment, thereby allowing for the use of dust cap 100" in a standard multiple jack arrangement.

In example embodiments, the components of the dust cap 100 may be made of a plastic material, such as injection molded polyethylene and polypropylene. Other materials can be used.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the disclosure.

PARTS LIST

100 first embodiment dust cap
110 cover portion
110*a* front face
110*b* rear face
112 handle
114 first securing feature
114*a* side wall
114*b* side wall
114*c* chamfered portion
h1 first height of sidewall
h2 second height of sidewall
t1 thickness of sidewall
116 second securing feature
116*a* horizontal wall
116*b* horizontal wall sides
116*c* support features
w1 width of horizontal wall
118 extension portion
118 increased material location
120 hinge member
122 apertures
150 hinge base
152 main body
152*a* front face
152*b* rear face
152*c* recessed portions
154 female hinge portions
154*a* recess
156 adhesive
158 release liner
158*a* release liner tab
200 jack receptacle
202 main body
204 front face
206 recess
206*a* wall—main side
206*b* wall—main side
206*c* wall—main top
206*d* wall—inset side at bottom
206*e* wall—inset side at bottom
206*f* plug tab latch connector
208 contact springs
220 wall cover plate
300 plug
302 plug latch tab
100' second embodiment dust cap
110' cover portion
110*a*' front face
110*b*' rear face
112' handle
114' first securing feature
116' second securing feature
118' living hinge
150' hinge base
152' main body
152*a*' front face
152*b* rear face
156' adhesive
158' release liner
100" third embodiment dust cap
110" cover portion
112" handle portion
114" first securing feature
116" second securing feature
150" hinge base
150*a*" sloped portion
154" hinge portions

What is claimed is:

1. A dust cap (100) for covering a jack recess (206) in a telecommunications jack (200) comprising:

(a) a cover portion (110) rotatable from a closed position to an open position, the cover portion (110) being configured to cover the jack recess (206) in an closed position and to expose the jack recess (206) in an open position, the cover portion (110) including:

i. a securing feature (114, 116) located on a rear face (110*b*) of the cover portion (110), the securing feature (114, 116) being configured to engage with the jack recess (206) to retain the cover portion (110) in the closed position;

ii. a handle portion (112) located on a front face (110*a*) of the cover portion (110), the handle portion (112) being configured to allow a user to move the cover portion (110) between the open and closed positions with a single phalange;

(b) a hinge base (150) rotatably mounted to the cover portion (110), the hinge base (150) including:

i. an adhesive (156) located on a rear face (150*b*) of the hinge base, the adhesive (156) being configured to engage with a front face (204) of the telecommunications jack (200) to secure the dust cap (100) to the telecommunications jack (200); wherein the hinge base (150) further includes a release liner (158) removably attached to the adhesive (156).

2. The dust cap (100) of claim 1, wherein the adhesive (156) is a double-sided tape having a first side and a second side, the first side being adhered to the hinge base.

3. The dust cap (100) of claim 1, wherein the cover portion (110) includes a male hinge portion (120) that is received by a female hinge portion (154) located on the hinge base (150).

4. The dust cap (100) of claim 3, wherein the cover portion (110) is attached to the hinge base (150) with a snap-fit connection.

5. The dust cap (100) of claim 1, wherein the cover portion (110) and the hinge base are rotatably connected by a living hinge (118').

6. The dust cap (100) of claim 1, wherein the rear face (150*b*) of the hinge base (150) has a surface area that is less than the surface area of a front face (204) of the telecommunications jack (200) for which the dust cap (100) is configured.

7. The dust cap (100) of claim 1, further comprising a telecommunications jack (200), the dust cap (100) positioned for covering a jack recess (206), the cover portion (110) rotatable from a closed position, wherein the cover portion (110) covers the jack recess (206), to an open position, wherein the jack recess (206) is exposed, the dust cap (100) including an adhesive (156) located on a rear face (150*b*) of the hinge base (150) that is configured to engage with a front face (204) of the telecommunications jack (200) to secure the dust cap (100) to the telecommunications jack (200).

8. The dust cap (100) of claim 7, wherein the cover portion (110) includes a securing feature (114, 116) configured to engage with the jack recess (206) to retain the cover portion (110) in the closed position.

9. The dust cap (100) of claim 8, wherein the front face (110*a*) of the cover portion (110) includes a handle (112).

10. The dust cap (100) of claim 1, wherein the release liner (158) has a tabbed portion (158*a*) that extends beyond the hinged base (150).

11. The dust cap (100) of claim 1, wherein the hinge base (150) has recessed portions (152*c*) in the front face (152*a*) to increase clearance between the cover portion 110 and the hinged base (150).

12. A method of using a dust cap (100) for covering a jack recess (206) in a telecommunications jack (200) comprising:

(a) providing a cover portion (110) rotatable from a closed position to an open position, the cover portion (110) being configured to cover the jack recess (206) in an closed position and to expose the jack recess (206) in an open position, the cover portion (110) including:

i. a securing feature (114, 116) located on a rear face (110*b*) of the cover portion (110), the securing feature (114, 116) being configured to engage with the jack recess (206) to retain the cover portion (110) in the closed position;

ii. a handle portion (112) located on a front face (110*a*) of the cover portion (110), the handle portion (112) being configured to allow a user to move the cover portion (110) between the open and closed positions with a single phalange;

(b) providing a hinge base (150) rotatably mounted to the cover portion (110), the hinge base (150) including:

i. an adhesive (156) located on a rear face (150*b*) of the hinge base, the adhesive (156) being configured to engage with a front face (204) of the telecommunications jack (200) to secure the dust cap (100) to the telecommunications jack (200); wherein the hinge base (150) further includes a release liner (158) removably attached to the adhesive (156);

(c) mounting the dust cap positioned for covering a jack recess (206), the cover portion (110) rotatable from a closed position, wherein the cover portion (110) covers the jack recess (206), to an open position, wherein the jack recess (206) is exposed, the dust cap (100) including an adhesive (156) located on a rear face (150*b*) of the hinge base (150) that engages with a front face (204) of the telecommunications jack (200) to secure the dust cap (100) to the telecommunications jack (200).

* * * * *